US008812307B2

(12) United States Patent
Xu et al.

(10) Patent No.: US 8,812,307 B2
(45) Date of Patent: Aug. 19, 2014

(54) METHOD, APPARATUS AND SYSTEM FOR LINEAR PREDICTION CODING ANALYSIS

(75) Inventors: Jianfeng Xu, Munich (DE); Lei Miao, Shenzhen (CN); Fengyan Qi, Beijing (CN); Dejun Zhang, Beijing (CN); Qing Zhang, Shenzhen (CN)

(73) Assignee: Huawei Technologies Co., Ltd, Shenzhen (CN)

( * ) Notice: Subject to any disclaimer, the term of this patent is extended or adjusted under 35 U.S.C. 154(b) by 1 day.

(21) Appl. No.: 13/228,965

(22) Filed: Sep. 9, 2011

(65) Prior Publication Data

US 2011/0320195 A1 Dec. 29, 2011

Related U.S. Application Data

(63) Continuation of application No. PCT/CN2009/070729, filed on Mar. 11, 2009.

(51) Int. Cl.
*G10L 19/00* (2013.01)
*G10L 19/022* (2013.01)
*G10L 19/04* (2013.01)

(52) U.S. Cl.
CPC ..... *G10L 19/022* (2013.01); *G10L 19/04* (2013.01)
USPC ..... 704/219; 704/500

(58) Field of Classification Search
CPC ..... G10L 25/90; G10L 19/12; G10L 17/26; G10L 19/02; G10L 19/087
USPC ..... 704/200–230, 500–504
See application file for complete search history.

(56) References Cited

U.S. PATENT DOCUMENTS

| | | | | |
|---|---|---|---|---|
| 5,214,742 | A * | 5/1993 | Edler | 704/203 |
| 5,305,421 | A * | 4/1994 | Li | 704/219 |
| 5,642,464 | A | 6/1997 | Yue et al. | |
| 5,787,390 | A | 7/1998 | Quinquis et al. | |
| 5,848,391 | A | 12/1998 | Bosi et al. | |
| 6,311,154 | B1 | 10/2001 | Gersho et al. | |

(Continued)

FOREIGN PATENT DOCUMENTS

| | | | |
|---|---|---|---|
| CN | 1338096 | A | 2/2002 |
| CN | 1387131 | A | 12/2002 |

(Continued)

OTHER PUBLICATIONS

Written Opinion of the International Searching Authority regarding Int'l Application No. PCT/CN2009/070729; Filing Date of Mar. 11, 2009; mailing date of Dec. 10, 2009 for Huawei Technologies Co., Ltd. et al. (6 pgs.).

(Continued)

*Primary Examiner* — Samuel G Neway
(74) *Attorney, Agent, or Firm* — Huawei Technologies Co., Ltd

(57) ABSTRACT

The present invention relates to communication technologies and discloses a method, an apparatus and a system for Linear Prediction Coding (LPC) analysis to improve LPC prediction performance and simplify analysis operation. The method includes: obtaining signal feature information of at least one sample point of input signals; comparing and analyzing the signal feature information to obtain an analysis result; selecting a window function according to the analysis result to perform adaptive windowing for the input signals and obtain windowed signals; and processing the windowed signals to obtain an LPC coefficient for linear prediction. The embodiments of the present invention are applicable to LPC.

12 Claims, 6 Drawing Sheets

(56) References Cited

U.S. PATENT DOCUMENTS

| | | | | |
|---|---|---|---|---|
| 6,704,705 | B1 * | 3/2004 | Kabal et al. | 704/230 |
| 6,978,236 | B1 | 12/2005 | Liljeryd | |
| 2002/0184008 | A1 | 12/2002 | Miseki | |
| 2003/0139830 | A1 | 7/2003 | Tsuji et al. | |
| 2004/0083096 | A1 | 4/2004 | Chu et al. | |
| 2004/0098268 | A1 * | 5/2004 | Ha | 704/500 |
| 2005/0204904 | A1 * | 9/2005 | Lengeling et al. | 84/668 |
| 2005/0228647 | A1 * | 10/2005 | Fisher | 704/205 |
| 2006/0173675 | A1 | 8/2006 | Ojanpera | |
| 2007/0118368 | A1 | 5/2007 | Suzuki et al. | |
| 2008/0027719 | A1 * | 1/2008 | Kirshnan et al. | 704/214 |
| 2008/0270124 | A1 | 10/2008 | Son et al. | |
| 2008/0312914 | A1 | 12/2008 | Rajendran et al. | |
| 2009/0198501 | A1 * | 8/2009 | Jeong et al. | 704/500 |

FOREIGN PATENT DOCUMENTS

| | | | |
|---|---|---|---|
| CN | 1732530 | A | 2/2006 |
| CN | 1732530 | A | 2/2006 |
| KR | 200421226 | B1 | 7/2004 |
| WO | WO 2010/102446 | A1 | 9/2010 |

OTHER PUBLICATIONS

International Search Report regarding Int'l Application No. PCT/CN2009/070729; Filing Date of Mar. 11, 2009; mailing date of Dec. 10, 2009 for Huawei Technologies Co., Ltd. et al. (6 pgs.).

First Chinese Office Action (translation) of Chinese Application No. 200980000109.2; mailing date of Aug. 31, 2011; Chinese version attached (18 pgs.).

Kabal, Peter.; Ill-Conditioning and Bandwidth Expansion in Linear Prediction of Speech; IE 0-7803-7663-3; Mar. 2003 (4 pgs.).

Liebchen, Tilman, et al.; MPEG-4 Audio Lossless Coding; Convention Paper 6047; Audio Engineering Society; Presented at the 116$^{th}$ Convention on May 8-11, 2004 in Berlin, Germany; (9 pgs.).

Yu, Rongshan, et al.; MPEG-4 Scalable to Lossless Audio Coding; Convention Paper 6183; Audio Engineering Society; Presented at the 117$^{th}$ Convention on Oct. 28-31, 2004 in San Francisco, CA; (14 pgs.).

Information technology—Coding of audio-visual objects—Part 3: Audio, Amendment 2: Audio Lossless Coding (ALS), new audio profiles and BSAC extensions; ISO/IEC JTC 1/SC 29; Dated Aug. 12, 2005; ISO/IEC 14496-3:2005/FDAM 2:2005(E); ISO/IEC JTC 1/SC 29/WG 11 Secretariat; STD Version 2.1c2; (84 pgs.).

International Telecommunication Union; Telecommunication Standardization Sector; Study Period 2005-2008; ITU-T WP3/16; Document AC-0710-Q10-07; Dated Oct. 8-12, 2007—Geneva; Question(s): 10/16; Source: Cisco Systems, Inc.; Title: G711 Lossless Compression Algorithm: Market Need, Use Cases and Design Requirements; Purpose: Discussion (7 pgs.).

International Telecommunication Union; Telecommunication Standardization Sector; Study Period 2005-2008; ITU-T WP3/16; Document AC-0710-Q10-08; Dated Oct. 8-12, 2007—Geneva; Question(s): 10/16; Source: Cisco Systems, Inc.; Title: A G711 Lossless Compression Algorithm Proposal; Purpose: Proposal (21 pgs.).

Search report issued in corresponding European patent application No. 09841315.6, dated Jul. 4, 2012, total 7 pages.

First Chinese Office Action mailed Aug. 31, 2011, issued in related Chinese Application No. 200980000109.2, Huawei Technologies Co., Ltd. (18 pages).

1st office action issued in corresponding Korean patent application 10-2011-7023175, dated Oct. 31, 2012,and English translation thereof, total 6 pages.

1st office action issued in corresponding European patent application No. 09841315.6, dated Mar. 6, 2013, total 8 pages.

Orit Lev et al. :"Low bit-rate speech coder based on a long-term model", Jan. 1, 2002, total 3 pages.

2nd office action issued in corresponding Korean patent application 10-2011-7023175, dated Apr. 29, 2013,and English translation thereof, total 6 pages.

* cited by examiner

METHOD, APPARATUS AND SYSTEM FOR LINEAR PREDICTION CODING ANALYSIS

CROSS-REFERENCE TO RELATED APPLICATIONS

This application is a continuation of International Application No. PCT/CN2009/070729, filed on Mar. 11, 2009, which is hereby incorporated by reference in its entirety.

FIELD OF THE INVENTION

The present invention relates to communication technologies, and in particular, to a method, an apparatus, and a system for Linear Prediction Coding (LPC) analysis.

BACKGROUND OF THE INVENTION

In order to save bandwidth for transmitting and storing voice and audio signals, voice and audio coding technologies are applied widely, for example, lossy coding and lossless coding. In the lossy coding, the reconstructed signals are not completely the same as the original signals, but redundant information of signals may be minimized according to the sound source features and the human perception features. In the lossless coding, the reconstructed signals need to be completely the same as the original signals so that the final decoding quality is not impaired at all. Generally, in the lossy coding, the compression ratio is high, but the quality of the reconstructed voice may not be ensured; in the lossless coding, the voice quality is ensured, but the compression ratio is as low as about 50%.

In both the lossy coding and the lossless coding, an LPC (Linear Prediction Coding) model is widely applied to voice coding. In the lossy coding, a typical application of the LPC model is Code Excited Linear Prediction (CELP) coding model. The fundamentals of the CELP coding model are: remove the near sample point redundancy of voice signals by using short-time linear prediction, remove the far sample point redundancy of voice signals by using a long-time predictor, and perform coded transmission for parameters generated in the prediction process and residual signals obtained through the two levels of prediction.

Currently, the LPC analysis of lossy and lossless audio coding/decoding generally involves three modules: windowing module auto-correlation module, and Levinson algorithm module. Residual signals are obtained through linear prediction, and are coded through entropy coding to implement audio compression.

In the process of LPC, the prior art at least exists the following problems:

A fixed window function is applied in the windowing process, which makes the linear prediction performance not optimal.

Alternatively, the input signals undergo two rounds of LPC analysis; in the first round of LPC analysis, a short window is applied to the signals; in the second round of LPC analysis, a long window is applied to the signals, which increases complexity of the LPC analysis.

SUMMARY OF THE INVENTION

The embodiments of the present invention provide a method, an apparatus and a system for LPC analysis to improve linear prediction performance and simplify analysis operation.

An LPC analysis method includes:

obtaining signal feature information of at least one sample point of input signals;

comparing and analyzing the signal feature information to obtain an analysis result; and selecting a window function according to the analysis result to perform adaptive windowing for the input signals and obtain windowed signals; and processing the windowed signals to obtain an LPC coefficient for linear prediction.

Through the LPC analysis method provided in the present invention, the input signals are analyzed to obtain an analysis result, and a window function required for windowing is allocated adaptively according to the analysis result. In this way, the prediction performance of LPC is improved with little increased complexity of coding.

An LPC analysis apparatus includes:

an obtaining unit, configured to obtain signal feature information of at least one sample point of input signals;

an analyzing unit, configured to compare and analyze the signal feature information to obtain an analysis result;

a windowing unit, configured to select a window function according to the analysis result to perform adaptive windowing for the input signals and obtain windowed signals; and a processing unit, configured to process the windowed signals to obtain an LPC coefficient for linear prediction.

The LPC analysis apparatus provided in embodiments of the present invention are configured to analyze the input signals to obtain an analysis result, and allocate adaptively a window function required for windowing according to the analysis result. In this way, the prediction performance of LPC is improved with little increased complexity of coding.

An LPC system includes:

an LPC analysis apparatus, configured to: obtain signal feature information of at least one sample point of input signals; compare and analyze the signal feature information to obtain an analysis result; select a window function according to the analysis result to perform adaptive windowing for the input signals and obtain windowed signals; and process the windowed signals to obtain an LPC coefficient; and a coding apparatus, configured to perform coding according to the LPC coefficient obtained by the LPC analysis apparatus.

Through the LPC system provided in embodiments of the present invention, the input signals are analyzed to obtain an analysis result, and a window function required for windowing is allocated adaptively according to the analysis result to obtain an LPC coefficient, and then coding is performed according to the LPC coefficient. In this way, the prediction performance of LPC is improved with little increased complexity of coding.

BRIEF DESCRIPTION OF THE DRAWINGS

To make embodiments of the present invention or technical solutions in the prior art clearer, the following outlines the accompanying drawings involved in the embodiments of the present invention or the prior art. Apparently, the accompanying drawings outlined below are illustrative rather than exhaustive, and persons of ordinary skill in the art can derive other drawings from them without any creative effort.

DETAILED DESCRIPTION OF THE EMBODIMENTS

The following detailed description is given in conjunction with the accompanying drawings to provide a thorough understanding of the present invention. Evidently, the described embodiments are merely part of rather than all embodiments. All other embodiments, which can be derived by those skilled in the art from the embodiments given herein without any creative effort, shall fall within the scope of the present invention.

The embodiments of the present invention provide a method, an apparatus and a system for LPC analysis to improve linear prediction performance and simplify analysis operation.

The embodiments of the present invention are described in detail below with reference to accompanying drawings.

Figure 1:
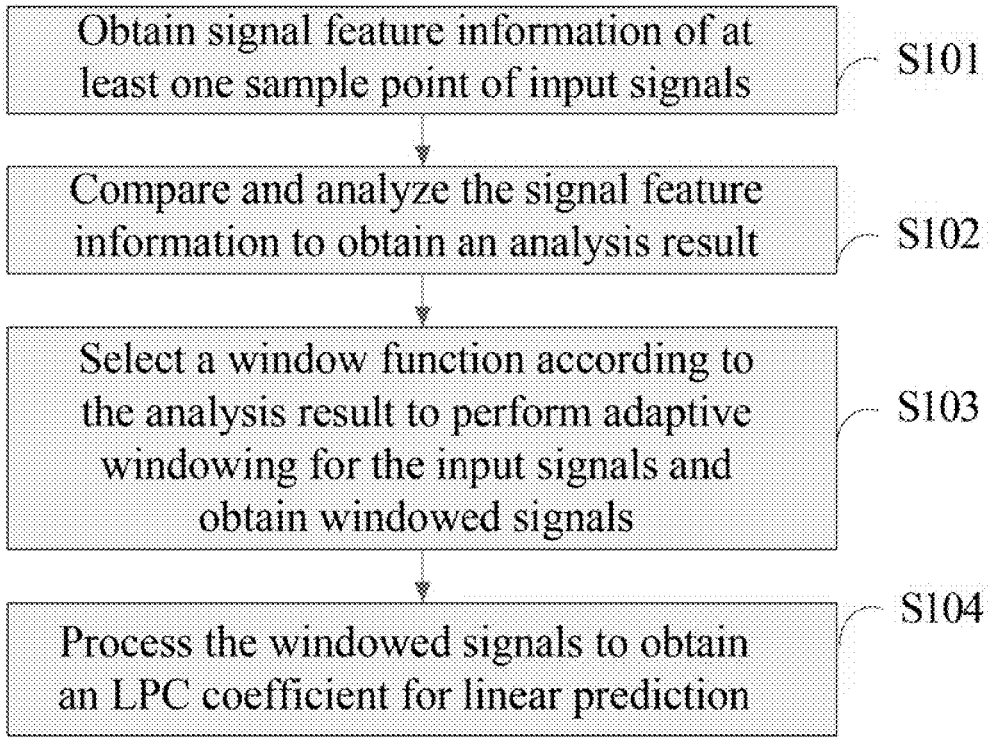
FIG. 1 is a block flowchart of an LPC analysis method according to an embodiment of the present invention.

As shown in FIG. 1, an LPC analysis method provided in an embodiment of the present invention includes the following steps:

S101. Obtain signal feature information of at least one sample point of input signals.

S102. Compare and analyze the signal feature information to obtain an analysis result.

S103. Select a window function according to the analysis result to perform adaptive windowing for the input signals and obtain windowed signals.

S104. Process the windowed signals to obtain an LPC coefficient for linear prediction.

Through the LPC analysis method provided herein, the input signals are analyzed to obtain an analysis result, and a window function required for windowing is allocated adaptively according to the analysis result. In this way, the prediction performance of LPC is improved with little increased complexity of coding.

The information feature information includes any one or any combination of amplitude, energy, zero-crossing rate, signal type, frame length, coding mode.

The method is described with the following embodiments of the present invention.

Embodiment 1

Figure 2:
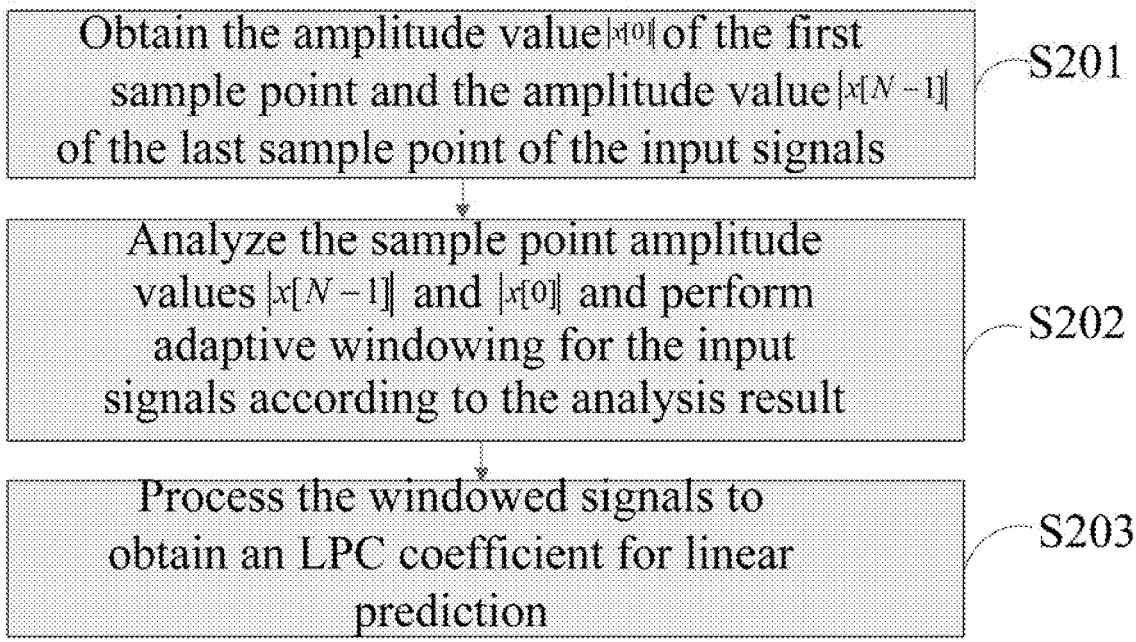
FIG. 2 is a block flowchart of an LPC analysis method according to a first embodiment of the present invention.

As shown in FIG. 2, an LPC analysis method provided in the first embodiment of the present invention includes the following steps:

S201. Obtain an amplitude value |x[0]| of a first sample point and an amplitude value |x[N−1]| of a last sample point of input signals, where x[i], i=0, 1, . . . , N−1 are input signals, N is the number (such as 40, 80, 160, 240, or 320) of sample points of the input signals. The input signals herein refer to signals input for LPC analysis, and may be a frame of signals, or may be a frame of signals plus a segment of signals in a history buffer (such as L sample points in the history buffer, where L is a positive integer such as 40, 80, 160, 240, or 320, according to the type of codec).

S202. Analyze amplitude values |x[0]| and |x[N−1]| of the sample point and perform adaptive windowing for the input signals according to the analysis result.

For example, when the number of sample points of the input signals is 40:

If the amplitude value |x[0]| of the first sample point of the input signals is less than a preset threshold thr (such as thr=128), the first 4 points of the window function are set as:

$$w(n)=0.23+0.77\cdot\cos(2\cdot\pi\cdot(31-8\cdot n)/127),\ n=0, 1, 2, 3.$$

Otherwise, the first 4 points of the window function are set as:

$$w(n)=0.26+0.74\cdot\cos(2\cdot\pi\cdot(31-8\cdot n)/127),\ n=0, 1, 2, 3.$$

Points 5-36 of the window function are set to 1s, namely, $$w(n)=1,\ n=4, \ldots, 35.$$

If the amplitude value |x[39]| of the last sample point of the input signals is less than a preset threshold thr (such as thr=128), the last 4 points of the window function are set as:

$$w(n)=0.23+0.77\cdot\cos(2\cdot\pi\cdot(8\cdot n-281)/127),\ n=36, 37, 38, 39.$$

Otherwise, the last 4 points of the window function are set as:

$$w(n)=0.26+0.74\cdot\cos(2\cdot\pi\cdot(8\cdot n-281)/127),\ n=36, 37, 38, 39.$$

Afterward, signals x(n), n=1, 2, . . . , 38, 39 are windowed by using the adaptively set window function w(n), n=1, 2, . . . , 38, 39, namely, $$xd[n]=x[n]\cdot w[n],\ n=0, 1, \ldots, 38, 39.$$

As a result, the adaptively windowed signals xd[n]], n=0, 1, . . . , 38, 39 are obtained.

In another example, when the number of sample points of the input signals is 80:

If the amplitude value |x[0]| of the first sample point of the input signals is less than a preset threshold thr (such as thr−128) the first 8 points of the window function are set as:

$$w(n)=0.26+0.74\cdot\cos(2\cdot\pi\cdot(31-4\cdot n)/127),\ n=0, 1, 2, \ldots, 7.$$

Otherwise, the first 8 points of the window function are set as:

$$w(n)=0.16+0.84\cdot\cos(2\cdot\pi\cdot(31-4\cdot n)/127),\ n=0, 1, 2, \ldots, 7.$$

Points 9-72 of the window function are set to 1s, namely, $$w(n)=1,\ n=8, \ldots, 71.$$

If the amplitude value |x[79]| of the last sample point of the input signals is less than a preset threshold thr (such as thr=128) the last 8 points of the window function are set as:

$$w(n)=0.26+0.74\cdot\cos(2\cdot\pi\cdot(4\cdot n-285)/127),\ n=72, 73, 74, \ldots, 79.$$

Otherwise, the last 8 points of the window function are set as:

$$w(n)=0.16+0.84\cdot\cos(2\cdot\pi\cdot(4\cdot n-285)/127),\ n=72, 73, 74, \ldots, 79.$$

Afterward, signals x(n), n=0, 1, . . . , 78, 79 are windowed by using the adaptively set window function w(n), n=0, 1, . . . , 78, 79, namely, $$xd[n]=x[n]\cdot w[n],\ n=0, 1, \ldots, 78, 79.$$

As a result, the adaptively windowed signals xd[n]], n=0, 1, . . . , 78, 79 are obtained.

The policy of adjusting the window function w[n] is selected through plenty of experiments according to the type of vocoder.

The threshold thr is also selected through plenty of experiments, for example, thr=128 or thr=157

S203. Process the windowed signals to obtain an LPC coefficient for linear prediction.

Through the LPC analysis method provided in the first embodiment, the amplitude values of the first sample point and the last sample point of the input signals are obtained, and the input signals are windowed adaptively according to the amplitude values of sample points. In this way, the prediction performance of LPC is improved with little increased complexity of coding.

Embodiment 2

Figure 3:
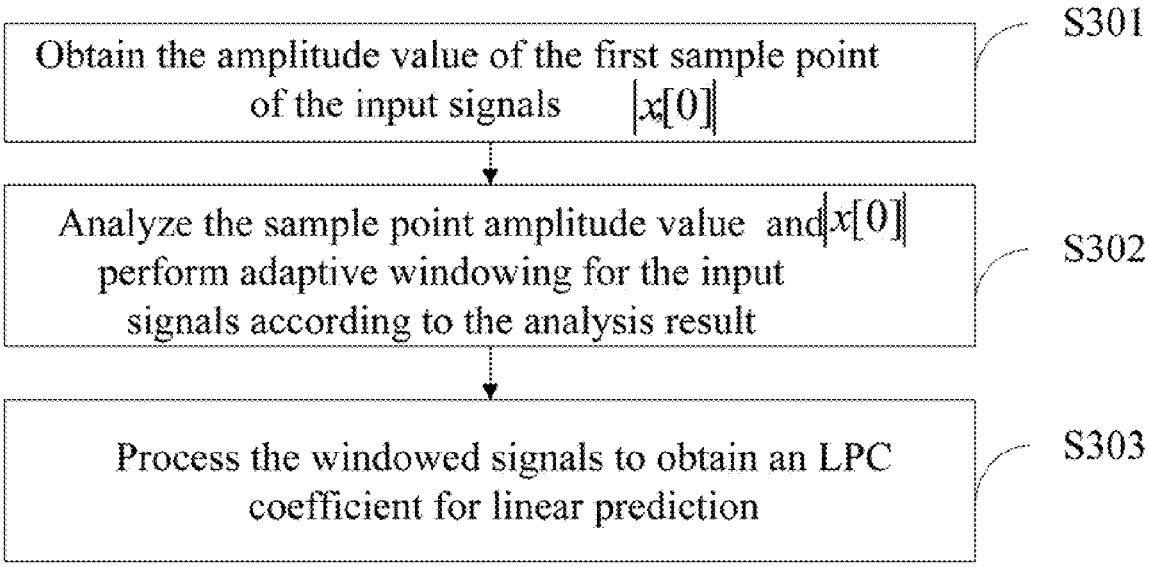
FIG. 3 is a block flowchart of an LPC analysis method according to a second embodiment of the present invention.

As shown in FIG. 3, an LPC analysis method provided in the second embodiment of the present invention includes the following steps:

S301. Obtain an amplitude value |x[0]| of a first sample point of input signals, where x[i], i=0, 1, . . . , N−1 refers to input signals, and N is the number of sample points of the input signals. The input signals herein refer to signals input for LPC analysis, and may be a frame of signals, or may be a frame of signals plus a segment of signals in a history buffer (such as L sample points in the history buffer, where L is a positive integer, such as 40 or 80, and value of L varies with the type of the codec).

S302. Analyze amplitude value |x[0]| of the sample point and perform adaptive windowing for the input signals according to the analysis result.

If the amplitude value |x[0]| of the first sample point of the input signals is greater than or equal to a preset threshold thr, the input signals are windowed by using the first window function, namely, by letting xd[i] be x[i] ·w1[i], i=0, 1, . . . , N−1, where xd[i] refers to windowed signals and w1[i] is the first window function.

Otherwise, the input signals are windowed by using the second window function, namely, by letting xd[i] be x[i]·w2[i]=0, 1, . . . , N−1, where w2[i] is the second window function.

The window function w1[i] and the window function w2[i] may be selected through plenty of experiments according to the type of vocoder, and are applicable to different signals. For example, w1[i] is a sine window and w2[i] is a Hamming window; or, w1[i] is a Hamming window and w2[i] is a sine window. The threshold thr may also be selected through plenty of experiments, for example, thr=128 or thr=157.

In an instance, thr=128; and, when the frame length N=80, $$w1[i]=\begin{cases}0.16+0.84\cdot\cos(2\cdot\pi\cdot(31-4\cdot i)/127), & i=0, 1, \ldots, 7\\ 1, & i=8, 9, \ldots, 71\\ 0.16+0.84\cdot\cos(2\cdot\pi\cdot(4\cdot i-285)/127), & i=72, 73, \ldots, 79\end{cases}$$

$$w2[i]=\begin{cases}0.26+0.74\cdot\cos(2\cdot\pi\cdot(31-4\cdot i)/127), & i=0, 1, \ldots, 7\\ 1, & i=8, 9, \ldots, 71\\ 0.26+0.74\cdot\cos(2\cdot\pi\cdot(4\cdot i-285)/127), & i=72, 73, \ldots, 79.\end{cases}$$

When the frame length N=40, $$w1[i]=\begin{cases}0.26+0.74\cdot\cos(2\cdot\pi\cdot(31-8\cdot i)/127), & i=0, 1, \ldots, 3\\ 1, & i=4, 5, \ldots, 35\\ 0.26+0.74\cdot\cos(2\cdot\pi\cdot(8\cdot i-281)/127), & i=36, 37, \ldots, 39\end{cases}$$

$$w1[i]=\begin{cases}0.23+0.77\cdot\cos(2\cdot\pi\cdot(31-8\cdot i)/127), & i=0, 1, \ldots, 3\\ 1, & i=4, 5, \ldots, 35\\ 0.23+0.77\cdot\cos(2\cdot\pi\cdot(8\cdot i-281)/127), & i=36, 37, \ldots, 39.\end{cases}$$

S303. Process the windowed signals to obtain an LPC coefficient for linear prediction.

Through the LPC analysis method provided in the second embodiment, the amplitude value of the first sample point of the input signals is obtained, and the input signals are windowed adaptively according to the amplitude value of the sample point. In this way, the prediction performance of LPC is improved with little increased complexity of coding.

Embodiment 3

Figure 4:
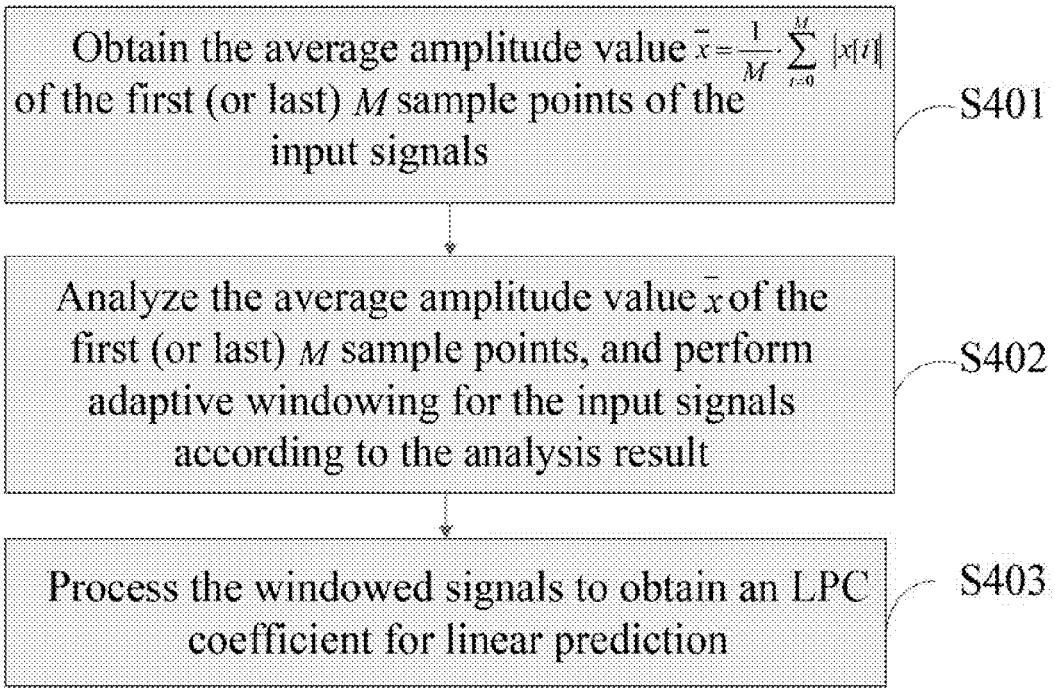
FIG. 4 is a block flowchart of an LPC analysis method according to a third embodiment of the present invention.

As shown in FIG. 4, an LPC analysis method provided in the third embodiment of the present invention includes the following steps:

S401. Obtain an average amplitude value $$\bar{x}=\frac{1}{M}\cdot\sum_{i\ 0}^{M}|x[i]|$$

of the first (or last) M sample points of input signals, where x[i], i=0, 1, . . . , N−1 refers to input signals, and N is the number of sample points of the input signals. The input signals herein refer to signals input for LPC analysis, and may be a frame of signals, or may be a frame of signals plus a segment of signals in a history buffer (such as L sample points in the history buffer, where L is a positive integer, such as 40 or 80, and value of L varies with the type of the codec).

S402. Analyze the average amplitude value $\bar{x}$ of the first (or last) M sample points, and perform adaptive windowing for the input signals according to the analysis result.

If the average amplitude value $\bar{x}$ of the first (or last) M sample points is greater than or equal to a preset threshold thr, the input signals are windowed by using the first window function, namely, by letting xd[i] be x[i]·w1[i], i=0, 1, . . . , N−1, where xd[i] refers to windowed signals and w1[i] is the first window function.

Otherwise, the input signals are windowed by using the second window function, namely, by letting xd[i] be x[i]·w2[i], i=0, 1, . . . , N−1, where w2[i] is the second window function.

The window function w1[i] and the window function w2[i] may be selected through plenty of experiments according to the type of vocoder, and are applicable to different signals. For example, w1[i] is a sine window and w2[i] is a Hamming window; or, w1[i] is a Hamming window and w2[i] is a sine window. The threshold thr may also be selected through plenty of experiments, for example, thr=127 or thr=152.

In an instance, thr=128; and, when the frame length N=80, $$w1[i]=\begin{cases}0.15+0.85\cdot\cos(2\cdot\pi\cdot(31-4\cdot i)/127), & i=0,1,\ldots,7\\ 1, & i=8,9,\ldots,71\\ 0.15+0.85\cdot\cos(2\cdot\pi\cdot(4\cdot i-285)/127), & i=72,73,\ldots,79\end{cases}$$

$$w2[i]=\begin{cases}0.27+0.73\cdot\cos(2\cdot\pi\cdot(31-4\cdot i)/127), & i=0,1,\ldots,7\\ 1, & i=8,9,\ldots,71\\ 0.27+0.73\cdot\cos(2\cdot\pi\cdot(4\cdot i-285)/127), & i=72,73,\ldots,79.\end{cases}$$

When the frame length N=40, $$w1[i]=\begin{cases}0.26+0.74\cdot\cos(2\cdot\pi\cdot(31-8\cdot i)/127), & i=0,1,\ldots,3\\ 1, & i=4,5,\ldots,35\\ 0.26+0.74\cdot\cos(2\cdot\pi\cdot(8\cdot i-281)/127), & i=36,37,\ldots,39\end{cases}$$

$$w1[i]=\begin{cases}0.23+0.77\cdot\cos(2\cdot\pi\cdot(31-8\cdot i)/127), & i=0,1,\ldots,3\\ 1, & i=4,5,\ldots,35\\ 0.23+0.77\cdot\cos(2\cdot\pi\cdot(8\cdot i-281)/127), & i=36,37,\ldots,39.\end{cases}$$

S403. Process the windowed signals to obtain an LPC coefficient for linear prediction.

Through the LPC analysis method provided in the third embodiment, the average amplitude value of the first (or last) M sample points of the input signals is obtained, and the input signals are windowed adaptively according to the average amplitude value. In this way, the prediction performance of LPC is improved with little increased complexity of coding.

Embodiment 4

Figure 5:
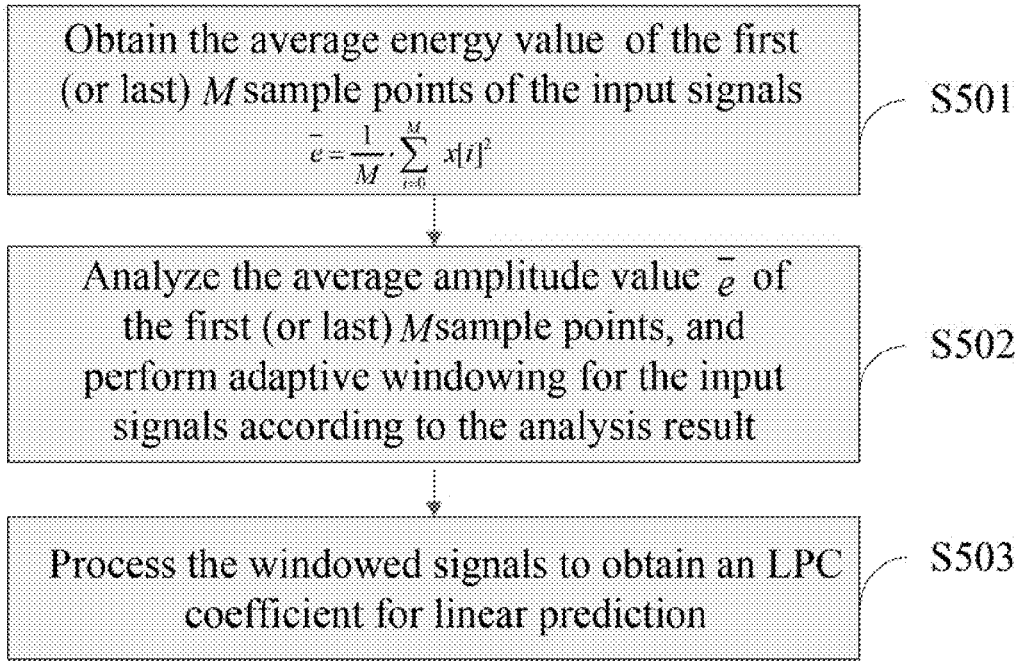
FIG. 5 is a block flowchart of an LPC analysis method according to a fourth embodiment of the present invention.

As shown in FIG. 5, an LPC analysis method provided in the fourth embodiment of the present invention includes the following steps:

S501. Obtain an average energy value $$\bar{e}=\frac{1}{M}\cdot\sum_{i=0}^{M}x[i]^2$$

of the first (or last) M sample points of input signals, where x[i], i=0, 1, . . . , N−1 refers to the input signals, and N is the number of sample points of the input signals.

The input signals herein refer to signals input for LPC analysis, and may be a frame of signals, or may be a frame of signals plus a segment of signals in a history buffer (such as L sample points in the history buffer, where L is a positive integer, such as 40 or 80, and value of L varies with the type of the codec).

S502. Analyze the average energy value $\bar{e}$ of the first (or last) M sample points, and perform adaptive windowing for the input signals according to the analysis result.

If the average energy value $\bar{e}$ of the first (or last) M sample points is greater than or equal to a preset threshold thr, the input signals are windowed by using the first window function, namely, by letting xd[i] be x[i]·w1[i], i=0, 1, . . . , N−1, where xd[i] refers to windowed signals and w1[i] is the first window function.

Otherwise, the input signals are windowed by using the second window function, namely, by letting xd[i] be x[i]·w2[i], i=0, 1, . . . , N−1, where w2[i] is the second window function.

The window function w1[i] and the window function w2[i] may be selected through plenty of experiments according to the type of vocoder, and are applicable to different signals. For example, w1[i] is a sine window and w2[i] is a Hamming window; or, w1[i] is a Hamming window and w2[i] is a sine window. The threshold thr may also be selected through plenty of experiments, for example, thr=1024 or thr=2573.

In an instance, thr=1280; and, when the frame length N=80, $$w1[i]=\begin{cases}0.18+0.82\cdot\cos(2\cdot\pi\cdot(31-4\cdot i)/127), & i=0,1,\ldots,7\\ 1, & i=8,9,\ldots,71\\ 0.18+0.82\cdot\cos(2\cdot\pi\cdot(4\cdot i-285)/127), & i=72,73,\ldots,79\end{cases}$$

$$w2[i]=\begin{cases}0.25+0.75\cdot\cos(2\cdot\pi\cdot(31-8\cdot i)/127), & i=0,1,\ldots,7\\ 1, & i=8,9,\ldots,71\\ 0.25+0.75\cdot\cos(2\cdot\pi\cdot(4\cdot i-285)/127), & i=72,73,\ldots,79.\end{cases}$$

When the frame length N=40, $$w1[i]=\begin{cases}0.25+0.75\cdot\cos(2\cdot\pi\cdot(31-8\cdot i)/127), & i=0,1,\ldots,3\\ 1, & i=4,5,\ldots,35\\ 0.25+0.75\cdot\cos(2\cdot\pi\cdot(8\cdot i-281)/127), & i=36,37,\ldots,39\end{cases}$$

$$w1[i]=\begin{cases}0.24+0.76\cdot\cos(2\cdot\pi\cdot(31-8\cdot i)/127), & i=0,1,\ldots,3\\ 1, & i=4,5,\ldots,35\\ 0.24+0.76\cdot\cos(2\cdot\pi\cdot(8\cdot i-281)/127), & i=36,37,\ldots,39.\end{cases}$$

S503. Process the windowed signals to obtain an LPC coefficient for linear prediction.

Through the LPC analysis method provided in the fourth embodiment, the average energy value of the first (or last) M sample points of the input signals is obtained, and the input signals are windowed adaptively according to the average energy value. In this way, the prediction performance of LPC is improved with little increased complexity of coding.

Embodiment 5

Figure 6:
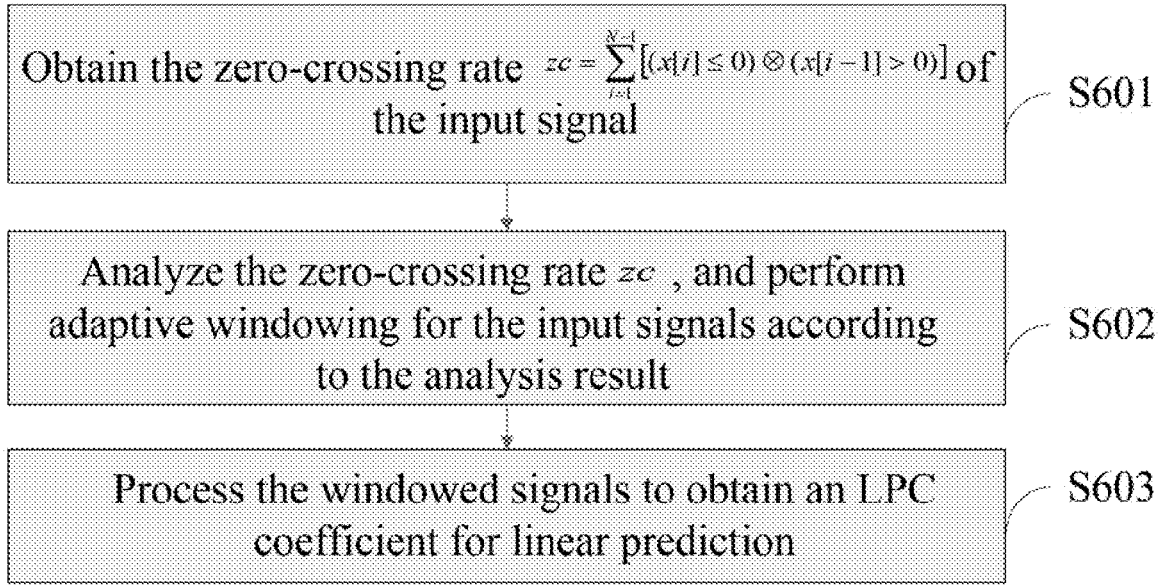
FIG. 6 is a block flowchart of an LPC analysis method according to a fifth embodiment of the present invention.

As shown in FIG. 6, an LPC analysis method provided in the fifth embodiment of the present invention includes the following steps:

S601. Obtain a zero-crossing rate $$zc=\sum_{i=1}^{N-1}[(x[i]\le 0)\otimes(x[i-1]>0)]$$

of the input signals, where x[i], i=0, 1, . . . , N−1 refers to the input signals, N is the number of sample points of the input signals, and ⊗ refers to AND operation.

The input signals herein refer to signals input for LPC analysis, and may be a frame of signals, or may be a frame of signals plus a segment of signals in a history buffer (such as L sample points in the history buffer, where L is a positive integer, such as 40 or 80, and value of L varies with the type of the codec).

S602. Analyze the zero-crossing rate zc, and perform adaptive windowing for the input signals according to the analysis result.

If the zero-crossing rate zc is greater than or equal to a preset threshold thr, the input signals are windowed by using the first window function, namely, by letting xd[i] be xd[i]=x[i]·w1[i] i=0, 1, . . . , N−1, where xd[i] refers to windowed signals and w1[i] is the first window function.

Otherwise, the input signals are windowed by using the second window function, namely, by letting xd[i] be xd[i]=x[i]·w2[i], i=0, 1, . . . , N−1, where w2[i] is the second window function.

The window function w[i] and the window function w2[i] may be selected through plenty of experiments according to the type of vocoder, and are applicable to different signals. For example, w1[i] is a sine window and w2[i] is a Hamming window; or, w1[i] is a Hamming window and w2[i] is a sine window.

The threshold thr may also be selected through plenty of experiments, for example, thr=15 or thr=23 .

In an instance, thr=18; and, when the frame length N=80, $$w1[i] = \begin{cases} 0.16 + 0.84 \cdot \cos(2 \cdot \pi \cdot (31 - 4 \cdot i)/127), & i = 0, 1, \ldots, 7 \\ 1, & i = 8, 9, \ldots, 71 \\ 0.16 + 0.84 \cdot \cos(2 \cdot \pi \cdot (4 \cdot i - 285)/127), & i = 72, 73, \ldots, 79 \end{cases}$$

$$w2[i] = \begin{cases} 0.26 + 0.74 \cdot \cos(2 \cdot \pi \cdot (31 - 4 \cdot i)/127), & i = 0, 1, \ldots, 7 \\ 1, & i = 8, 9, \ldots, 71 \\ 0.26 + 0.74 \cdot \cos(2 \cdot \pi \cdot (4 \cdot i - 285)/127), & i = 72, 73, \ldots, 79. \end{cases}$$

When the frame length N=40, $$w1[i] = \begin{cases} 0.27 + 0.73 \cdot \cos(2 \cdot \pi \cdot (31 - 8 \cdot i)/127), & i = 0, 1, \ldots, 3 \\ 1, & i = 4, 5, \ldots, 35 \\ 0.27 + 0.73 \cdot \cos(2 \cdot \pi \cdot (8 \cdot i - 281)/127), & i = 36, 37, \ldots, 39 \end{cases}$$

$$w1[i] = \begin{cases} 0.25 + 0.75 \cdot \cos(2 \cdot \pi \cdot (31 - 8 \cdot i)/127), & i = 0, 1, \ldots, 3 \\ 1, & i = 4, 5, \ldots, 35 \\ 0.25 + 0.75 \cdot \cos(2 \cdot \pi \cdot (8 \cdot i - 281)/127), & i = 36, 37, \ldots, 39. \end{cases}$$

S603. Process the windowed signals to obtain an LPC coefficient for linear prediction.

Through the LPC analysis method provided in the fifth embodiment, the zero-crossing rate of the input signals is obtained, and the input signals are windowed adaptively according to the zero-crossing rate. In this way, the prediction performance of LPC is improved with little increased complexity of coding.

Embodiment 6

Figure 7:
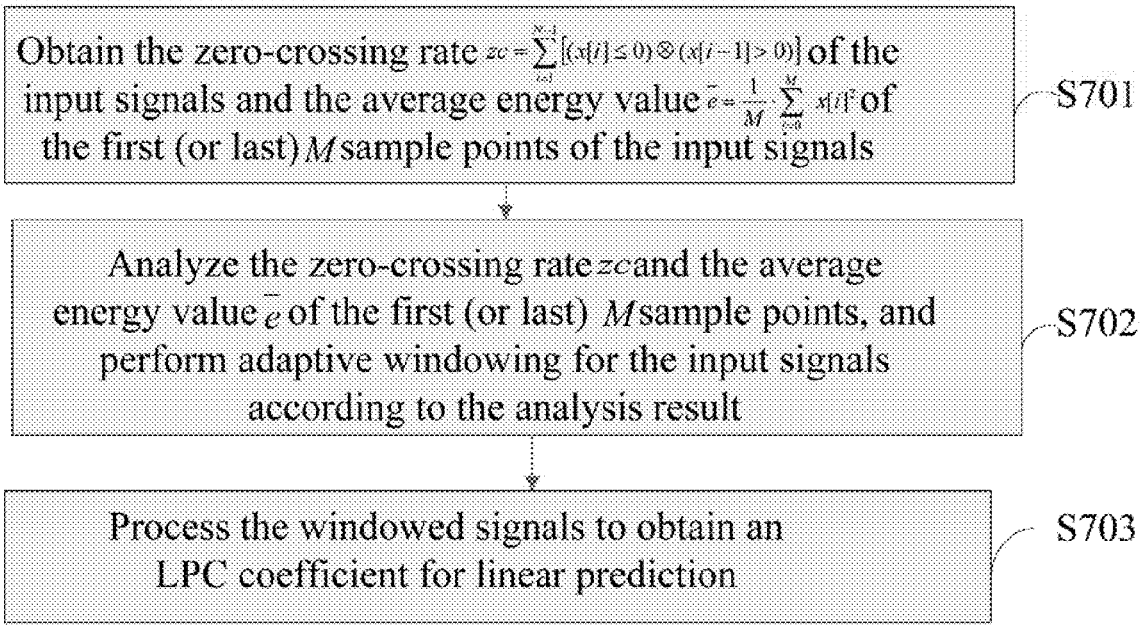
FIG. 7 is a block flowchart of an LPC analysis method according to a sixth embodiment of the present invention.

As shown in FIG. 7, an LPC analysis method provided in the sixth embodiment of the present invention includes the following steps:

S701. Obtain a zero-crossing rate $$zc = \sum_{i\ 1}^{N-1} [(x[i] < 0) \otimes (x[i-1] > 0)]$$

of input signals and an average energy value $$\bar{e} = \frac{1}{M} \cdot \sum_{i=0}^{M} x[i]^2$$

of the first (or last) M sample points, where x[i], i=0, 1, . . . , N−1 refers to the input signals, N is the number of sample points of the input signals, and ⊗ refers to AND operation. The input signals herein refer to signals input for LPC analysis, and may be a frame of signals, or may be a frame of signals plus a segment of signals in a history buffer (such as L sample points in the history buffer, where L is a positive integer, such as 40 or 80, and value of L varies with the type of the codec).

S702. Analyze the zero-crossing rate zc and the average energy value $\bar{e}$ of the first (or last) M sample points, and perform adaptive windowing for the input signals according to the analysis result.

If the zero-crossing rate zc is greater than or equal to a preset threshold thr1, or, if $\bar{e}$ is less than or equal to a preset threshold thr2, the input signals are windowed by using the first window function, namely, by letting xd[i] be x[i]·w1[i], i=0, 1, . . . , N−1, where xd[i] refers to windowed signals and w1[i] is the first window function.

Otherwise, the input signals are windowed by using the second window function, namely, by letting xd[i] be x[i]·w2[i], i=0, 1, . . . , N−1, where w2[i] is the second window function.

The window function w[i] and the window function w2[i] may be selected through plenty of experiments according to the type of vocoder, and are applicable to different signals. For example, w[i] is a sine window and w2[i] is a Hamming window; or, w1[i] is a Hamming window and w2[i] is a sine window. The threshold thr1 and the threshold thr2 may also be selected through plenty of experiments, for example, thr1=15 and thr2=1023; or thr1=23 and thr2=1012.

In an instance, thr1=17 and thr2=1012; and, when the frame length N=80, $$w1[i] = \begin{cases} 0.16 + 0.84 \cdot \cos(2 \cdot \pi \cdot (31 - 4 \cdot i)/127), & i = 0, 1, \ldots, 7 \\ 1, & i = 8, 9, \ldots, 71 \\ 0.16 + 0.84 \cdot \cos(2 \cdot \pi \cdot (4 \cdot i - 285)/127), & i = 72, 73, \ldots, 79 \end{cases}$$

$$w2[i] = \begin{cases} 0.26 + 0.74 \cdot \cos(2 \cdot \pi \cdot (31 - 4 \cdot i)/127), & i = 0, 1, \ldots, 7 \\ 1, & i = 8, 9, \ldots, 71 \\ 0.26 + 0.74 \cdot \cos(2 \cdot \pi \cdot (4 \cdot i - 285)/127), & i = 72, 73, \ldots, 79. \end{cases}$$

When the frame length N=40, $$w1[i] = \begin{cases} 0.28 + 0.72 \cdot \cos(2 \cdot \pi \cdot (31 - 8 \cdot i)/127), & i = 0, 1, \ldots, 3 \\ 1, & i = 4, 5, \ldots, 35 \\ 0.28 + 0.72 \cdot \cos(2 \cdot \pi \cdot (8 \cdot i - 281)/127), & i = 36, 37, \ldots, 39 \end{cases}$$

-continued $$w1[i]=\begin{cases}0.22+0.78\cdot\cos(2\cdot\pi\cdot(31-8\cdot i)/127), & i=0,1,\ldots,3\\ 1, & i=4,5,\ldots,35\\ 0.22+0.78\cdot\cos(2\cdot\pi\cdot(8\cdot i-281)/127), & i-36,37,\ldots,39.\end{cases}$$

S703. Process the windowed signals to obtain an LPC coefficient for linear prediction.

Through the LPC analysis method provided in the sixth embodiment, the zero-crossing rate of the input signals and the average energy value of the first (or last) M sample points of the input signals are obtained, and the input signals are windowed adaptively according to the zero-crossing rate and the average energy value. In this way, the prediction performance of LPC is improved with little increased complexity of coding.

Embodiment 7

Figure 8:
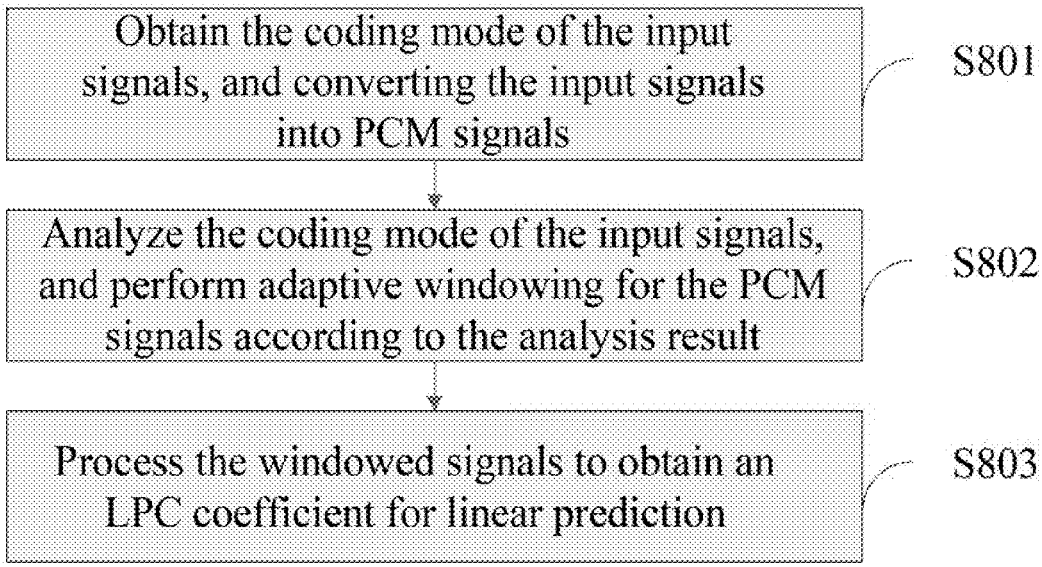
FIG. 8 is a block flowchart of an LPC analysis method according to a seventh embodiment of the present invention.

As shown in FIG. 8, an LPC analysis method provided in the seventh embodiment of the present invention includes the following steps:

S801. Obtain the coding mode of input signals, and convert the input signals into Pulse Coding Modulation (PCM) signals, where the input signals are G.711 signals, and the input signals may be A-law signals or mu-law signals.

S802. Analyze the coding mode of the input signals, and perform adaptive windowing for the PCM signals according to the analysis result.

If the coding mode is A-law, the PCM signals are windowed by using the first window function, namely, by letting xd[i] be x[i]·w1[i], i=0, 1, . . . , N−1, where xd[i] refers to windowed signals, w1[i] is the first window function, and x[i] refers to PCM signals.

Otherwise, the PCM signals are windowed by using the second window function, namely, by letting xd[i] be x[i]·w2[i], i=0, 1, . . . , N−1, where w2[i] is the second window function.

The window function w1[i] and the window function w2[i] may be selected through plenty of experiments according to the type of vocoder, and are applicable to different signals. For example, w1[i] is a sine window and w2[i] is a Hamming window; or, w1[i] is a Hamming window and w2[i] is a sine window.

In an instance, if the coding mode is A-law or mu-law, when the frame length N=80, $$w1[i]=\begin{cases}0.16+0.84\cdot\cos(2\cdot\pi\cdot(31-4\cdot i)/127), & i=0,1,\ldots,7\\ 1, & i=8,9,\ldots,71\\ 0.16+0.84\cdot\cos(2\cdot\pi\cdot(4\cdot i-285)/127), & i=72,73,\ldots,79\end{cases}$$

$$w2[i]=\begin{cases}0.26+0.74\cdot\cos(2\cdot\pi\cdot(31-4\cdot i)/127), & i=0,1,\ldots,7\\ 1, & i=8,9,\ldots,71\\ 0.26+0.74\cdot\cos(2\cdot\pi\cdot(4\cdot i-285)/127), & i=72,73,\ldots,79.\end{cases}$$

When the frame length N=40, $$w1[i]=\begin{cases}0.28+0.72\cdot\cos(2\cdot\pi\cdot(31-8\cdot i)/127), & i=0,1,\ldots,3\\ 1, & i=4,5,\ldots,35\\ 0.28+0.72\cdot\cos(2\cdot\pi\cdot(8\cdot i-281)/127), & i=36,37,\ldots,39\end{cases}$$

-continued $$w1[i]=\begin{cases}0.22+0.78\cdot\cos(2\cdot\pi\cdot(31-8\cdot i)/127), & i=0,1,\ldots,3\\ 1, & i=4,5,\ldots,35\\ 0.22+0.78\cdot\cos(2\cdot\pi\cdot(8\cdot i-281)/127), & i-36,37,\ldots,39.\end{cases}$$

S803. Process the windowed signals to obtain an LPC coefficient for linear prediction.

Through the LPC analysis method provided in the seventh embodiment, the coding mode of the input signals is obtained, the input signals are converted into PCM signals, and the input signals are windowed adaptively according to the coding mode. In this way, the prediction performance of LPC is improved with little increased complexity of coding.

Figure 9:
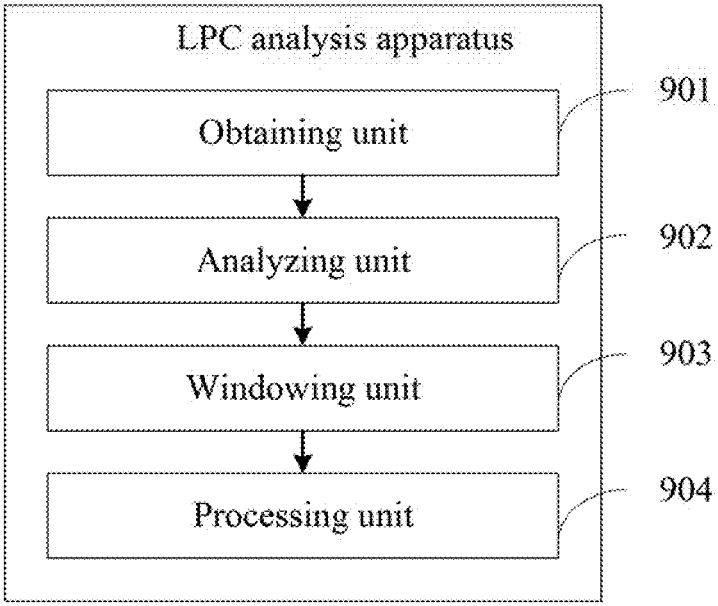
FIG. 9 is a structure block diagram of an LPC analysis apparatus according to an embodiment of the present invention.

An LPC analysis apparatus is provided in an embodiment of the present invention. As shown in FIG. 9, the apparatus includes:

an obtaining unit 901, configured to obtain signal feature information of at least one sample point of input signals;

an analyzing unit 902, configured to compare and analyze the signal feature information to obtain an analysis result;

a windowing unit 903, configured to select a window function according to the analysis result to perform adaptive windowing for the input signals and obtain windowed signals; and a processing unit 904, configured to process the windowed signals to obtain an LPC coefficient for linear prediction.

Through the LPC analysis apparatus provided herein, the input signals are analyzed to obtain an analysis result, and a window function required for windowing is allocated adaptively according to the analysis result. In this way, the prediction performance of LPC is improved with little increased complexity of coding.

Figure 10:
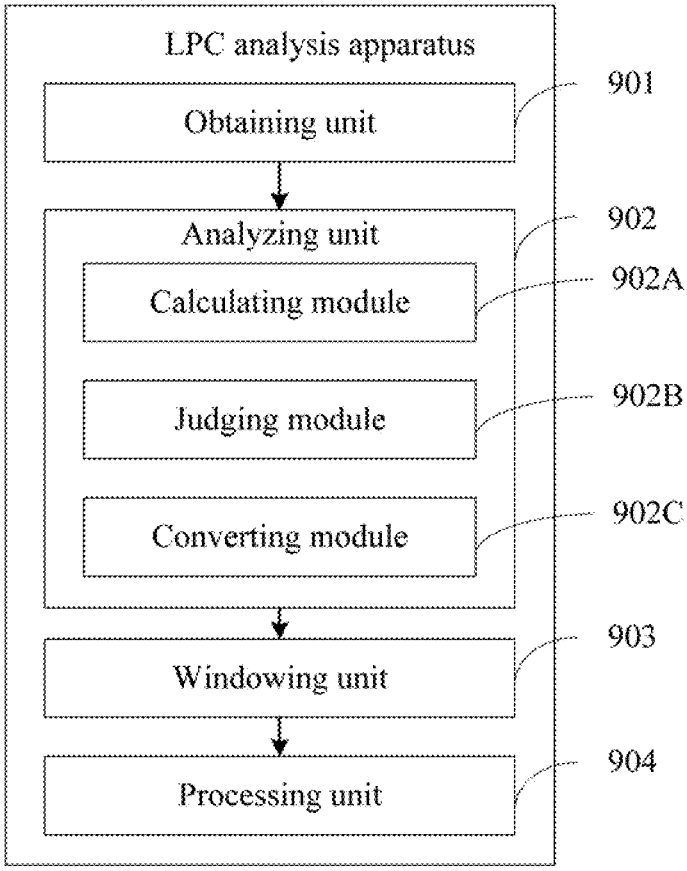
FIG. 10 is a structure block diagram of an LPC analysis apparatus according to another embodiment of the present invention.

As shown in FIG. 10, in another embodiment of the present invention, the analyzing unit 902 includes:

a calculating module 902A, configured to calculate a value of the signal feature information obtained by the obtaining unit 901, where the value of the signal feature information includes the value of signal feature information of a sample point and/or an average of values of signal feature information of multiple points; and a judging module 902B, configured to judge whether the value of the signal feature information, calculated by the calculating module 902A, is greater than or equal to a threshold, or judge the signal type and/or coding mode of the input signals obtained by the obtaining unit 901.

Further, the analyzing unit 902 mentioned above includes:

a converting module 902C, configured to convert the input signals obtained by the obtaining unit 901 into PCM signals.

Through the LPC analysis apparatus provided herein, the input signals are analyzed to obtain an analysis result, and a window function required for windowing is allocated adaptively according to the analysis result. In this way, the prediction performance of LPC is improved with little increased complexity of coding.

Figure 11:
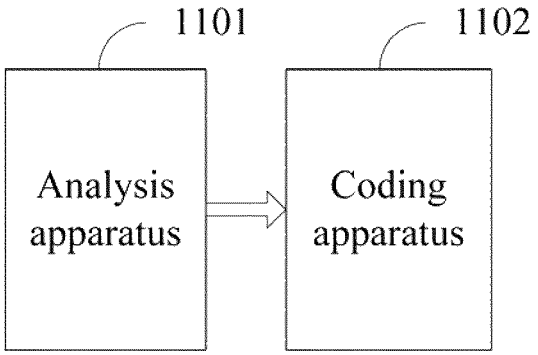
FIG. 11 is a structure block diagram of an LPC system according to an embodiment of the present invention.

An LPC system is provided in an embodiment of the present invention. As shown in FIG. 11, the system includes:

an LPC analysis apparatus 1101, configured to: obtain signal feature information of at least one sample point of input signals; compare and analyze the signal feature information to obtain an analysis result; select a window function according to the analysis result to perform adaptive windowing for the input signals, and obtain windowed signals; and process the windowed signals to obtain an LPC coefficient; and a coding apparatus 1102, configured to perform coding according to the LPC coefficient obtained by the LPC analysis apparatus 1101.

Through the LPC system provided herein, the input signals are analyzed to obtain an analysis result, and a window function required for windowing is allocated adaptively according to the analysis result to obtain an LPC coefficient, and then coding is performed according to the LPC coefficient. In this way, the prediction performance of LPC is improved with little increased complexity of coding.

Figure 12:
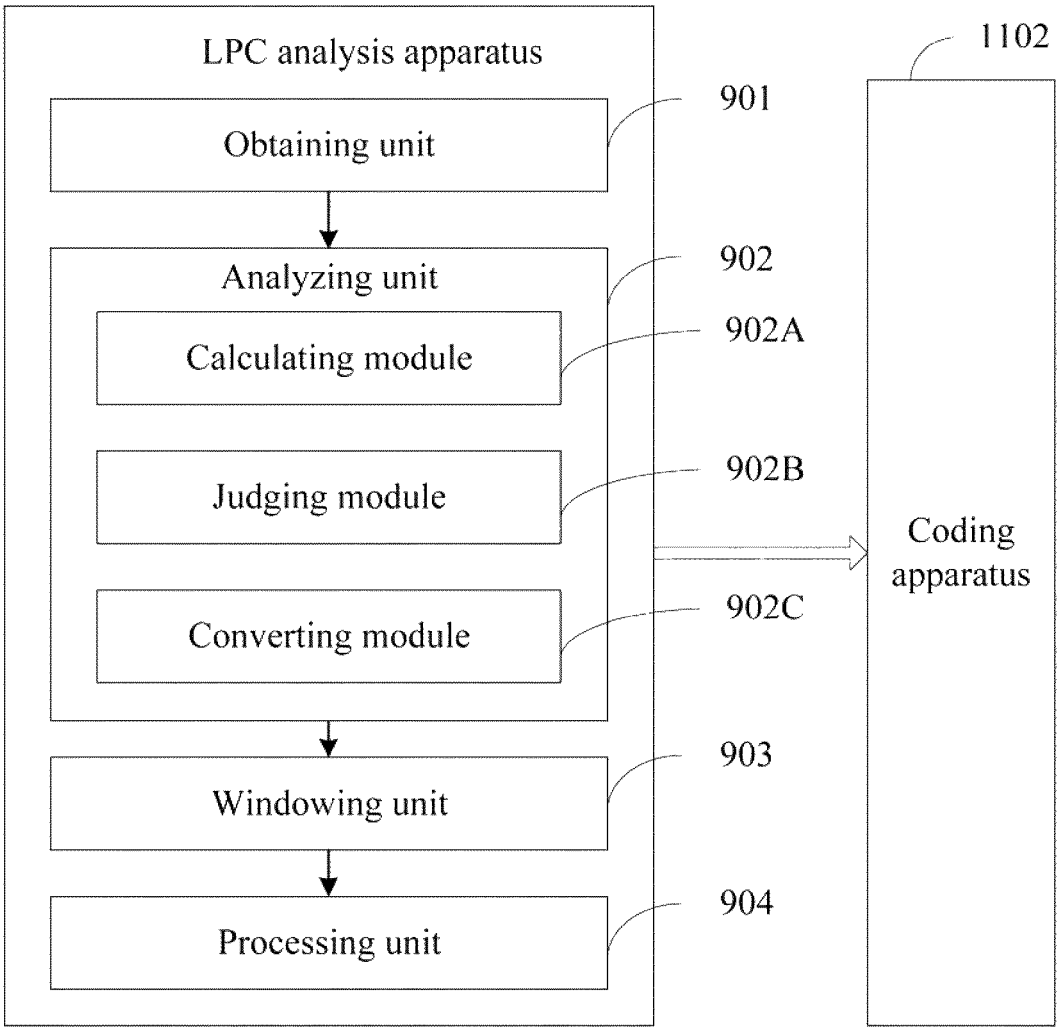
FIG. 12 is a structure block diagram of an LPC system according to another embodiment of the present invention.

As shown in FIG. 12, the LPC analysis apparatus 1101 in another embodiment of the present invention has the same structure as the LPC analysis apparatus in the above mentioned embodiment, and is not described in detail herein any further.

Through the LPC system provided herein, the input signals are analyzed to obtain an analysis result, and a window function required for windowing is allocated adaptively according to the analysis result to obtain an LPC coefficient, and then coding is performed according to the LPC coefficient. In this way, the prediction performance of LPC is improved with little increased complexity of coding.

Persons of ordinary skill in the art should understand that all or part of the steps of the method provided in the embodiments mentioned above may be implemented by a program instructing relevant hardware. The program may be stored in computer readable storage media. When the program runs, it may execute the steps of the method specified in any embodiment mentioned above. The storage media may be a magnetic disk, CD-ROM, Read-Only Memory (ROM), or Random Access Memory (RAM).

The above descriptions are merely exemplary embodiments of the present invention, but not intended to limit the scope of the present invention. Any modifications, variations or replacement that can be easily derived by those skilled in the art shall fall within the scope of the present invention. Therefore, the protection scope of the present invention is subject to the appended claims.

What is claimed is:

1. A Linear Prediction Coding (LPC) analysis method, wherein an input signal has 80 sample points x[n], n=0,1, . . . ,79, the method comprising:

obtaining, by a LPC analysis apparatus, an amplitude value |x[0]| of the first sample point and an amplitude value |x[79]| of the last sample point of an input signal;

determining, by the LPC analysis apparatus, whether the amplitude value |x[0]| of the first sample point is greater than or equal to a threshold, and whether the amplitude value |x[79]| of the last sample point is greater than or equal to the threshold;

obtaining, by the LPC analysis apparatus, a windowed signal by applying a window function w(n), n=0,1, . . . ,79 respectively on each of the sample points of the input signal; and processing, by the LPC analysis apparatus, the windowed signal to obtain an LPC coefficient for linear prediction;

wherein when the amplitude value |x[0]| of the first sample point is greater than or equal to the threshold, the first eight points of the window function are set as $$w(n)=0.16+0.84\cdot\cos(2\cdot\pi\cdot(31-4\cdot n)/127),\ n=0,1,\ldots,7;$$

or when the amplitude value |x[0]| of the first sample point is smaller than the threshold, the first eight points of the window function are set as $$w(n)=0.26+0.74\cdot\cos(2\cdot\pi\cdot(31-4\cdot n)/127),\ n=0,1,\ldots,7;$$

the 9th to 72nd points of the window function are set as w(n)=1, n=8,9, . . . ,71;

when the amplitude value |x[79]| of the last sample point is greater than or equal to the threshold, the last eight points of the window function are set as $$w(n)=0.16+0.84\cdot\cos(2\cdot\pi\cdot(4\cdot n-285)/127),\ n=72,73,\ldots,79;\ \text{or}$$

when the amplitude value |x[79]| of the last sample point is smaller than the threshold, the last eight points of the window function are set as $$w(n)=0.26+0.74\cdot\cos(2\cdot\pi(4\cdot n-285)/127),\ n=72,73,\ldots,79.$$

2. The LPC analysis method according to claim 1, wherein the threshold is 128 or 157.

3. The LPC analysis method according to claim 1, wherein obtaining, by the LPC analysis apparatus, an amplitude value of a sample point of the input signal comprises:

converting, by the LPC analysis apparatus, the input signal into a Pulse Coding Modulation (PCM) signal; and obtaining, by the LPC analysis apparatus, an amplitude value of a sample point of the PCM signal.

4. A Linear Prediction Coding (LPC) analysis apparatus for processing an input signal, wherein the input signal has 80 sample points x[n], n=0,1, . . . ,79, the apparatus comprising:

an obtaining unit, configured to obtain an amplitude value |x[0]| of the first sample point and an amplitude value |x[79]| of the last sample point of the input signal;

a processing unit, configured to determine whether the amplitude value |x[0]| of the first sample point is greater than or equal to a threshold, and whether the amplitude value |x[79]| of the last sample point is greater than or equal to the threshold, obtain a windowed signal by applying a window function w(n), n=0,1, . . . ,79, respectively on each of the sample points of the input signal, and process the windowed signal to obtain an LPC coefficient for linear prediction;

wherein when the amplitude value |x[0]| of the first sample point is greater than or equal to the threshold, the first eight points of the window function are set as $$w(n)=0.16+0.84\cdot\cos(2\cdot\pi\cdot(31-4\cdot n)/127),\ n=0,1,\ldots,7;$$

or when the amplitude value |x[0]| of the first sample point is smaller than the threshold, the first eight points of the window function are set as $$w(n)=0.26+0.74\cdot\cos(2\cdot\pi\cdot(31-4\cdot n)/127),\ n=0,1,\ldots,7;$$

the 9th to 72nd points of the window function are set as w(n)=1, n=8,9, . . . ,71;

when the amplitude value |x[79]| of the last sample point is greater than or equal to the threshold, the last eight points of the window function are set as $$w(n)=0.16+0.84\cdot\cos(2\cdot\pi\cdot(4\cdot n-285)/127),\ n=72,73,\ldots,79;\ \text{or}$$

when the amplitude value |x[79]| of the last sample point is smaller than the threshold, the last eight points of the window function are set as $$w(n)=0.26+0.74\cdot\cos(2\cdot\pi(4\cdot n=285)/127),\ n=72,73,\ldots,79.$$

5. The LPC analysis apparatus according to claim 4, wherein the threshold is 128 or 157.

6. The LPC analysis apparatus according to claim 4, wherein in obtaining an amplitude value of a sample point of the input signal, the obtaining unit is further configured to:

convert the input signal into a Pulse Coding Modulation (PCM) signal, and obtain an amplitude value of a sample point of the PCM signal.

7. A Linear Prediction Coding (LPC) system, comprising a LPC analysis apparatus and an encoding apparatus:

wherein the LPC analysis apparatus is configured to:

obtain an amplitude value |x[0]| of the first sample point and an amplitude value |x[79]| of the last sample point of an input signal, wherein the input signal has 80 sample points x[n], n=0,1, . . . ,79;

determine whether the amplitude value |x[0]| of the first sample point is greater than or equal to a threshold, and whether the amplitude value |x[79]| of the last sample point is greater than or equal to the threshold;

obtain a windowed signal by applying a window function w(n), n=0 ,1, . . . ,79, respectively on each of the sample points of the input signal; and process the windowed signal to obtain an LPC coefficient for linear prediction; and wherein the encoding apparatus is configured to perform encoding according to the LPC coefficient obtained by the LPC analysis apparatus, wherein when the amplitude value |x[0]| of the first sample point is greater than or equal to the threshold, the first eight points of the window function are set as $$w(n)=0.16+0.84\cdot\cos(2\cdot\pi\cdot(31-4\cdot n)/127),\ n=0,1,\ldots,7;$$

or when the amplitude value |x[0]| of the first sample point is smaller than the threshold, the first eight points of the window function are set as $$w(n)=0.26+0.74\cdot\cos(2\cdot\pi\cdot(31-4\cdot n)/127),\ n=0,1,\ldots,7;$$

the 9th to 72nd points of the window function are set as w(n)=1, n=8,9, . . . ,71;

when the amplitude value |x[79]| of the last sample point is greater than or equal to the threshold, the last eight points of the window function are set as $$w(n)=0.16+0.84\cdot\cos(2\cdot\pi\cdot(4\cdot n-285)/127),\ n=72,73,\ldots,79;\ \text{or}$$

when the amplitude value |x[79]| of the last sample point is smaller than the threshold, the last eight points of the window function are set as $$w(n)=0.26+0.74\cdot\cos(2\cdot\pi(4\cdot n-285)/127),\ n=72,73,\ldots,79.$$

8. A non-transitory computer readable storage medium, storing computer executable program codes that cause a computer processor to execute the following process:

obtaining an amplitude value |x[0]| of the first sample point and an amplitude value |x[79]| of the last sample point of an input signal, wherein the input signal has 80 sample points x[n], n=0,1, . . . ,79;

determining whether the amplitude value |x[0]| of the first sample point is greater than or equal to a threshold, and whether the amplitude value |x[79]| of the last sample point is greater than or equal to the threshold;

obtaining a windowed signal by applying a window function w(n), n=0 ,1, . . . ,79 respectively on each of the sample points of the input signal; and processing the windowed signal to obtain an Linear Prediction Coding (LPC) coefficient for linear prediction;

wherein when the amplitude value |x[0]| of the first sample point is greater than or equal to the threshold, the first eight points of the window function are set as $$w(n)=0.16+0.84\cdot\cos(2\cdot\pi\cdot(31-4\cdot n)/127),\ n=0,1,\ldots,7;$$

or when the amplitude value |x[0]| of the first sample point is smaller than the threshold, the first eight points of the window function are set as $$w(n)=0.26+0.74\cdot\cos(2\cdot\pi\cdot(31-4\cdot n)/127),\ n=0,1,\ldots,7;$$

the 9th to 72nd points of the window function are set as w(n)=1, n=8,9, . . . ,71;

when the amplitude value |x[79]| of the last sample point is greater than or equal to the threshold, the last eight points of the window function are set as $$w(n)=0.16+0.84\cdot\cos(2\cdot\pi\cdot(4\cdot n285)/127),\ n=72,73,\ldots,79;\ \text{or}$$

when the amplitude value |x[79]| of the last sample point is smaller than the threshold, the last eight points of the window function are set as $$w(n)=0.26+0.74\cdot\cos(2\cdot\pi(4\cdot n-285)/127),\ n=72,73,\ldots,79.$$

9. A method for a Linear Prediction Coding (LPC) analysis apparatus to construct a window function, wherein the LPC analysis apparatus comprises a processor and a memory unit, and wherein the window function has 80 value points w(n), n=0,1, . . . ,79, corresponding to 80 sample points of an input signal x[n], n=0,1, . . . ,79, the method comprising:

setting, by the processor of the LPC analysis apparatus, the first eight value points of the window function as w(n)=0.16+0.84·cos(2·π·(31−4n)/127), n=0,1, . . . ,7 when an amplitude value |x[0]| of the first sample point of the input signal is greater than or equal to a threshold; or setting, by the processor of the LPC analysis apparatus, the first eight value points of the window function as w(n)=0.26+0.74·cos(2·π·(31−4·n)/127), n=0,1, . . . ,7 when the amplitude value |x[0]| of the first sample point is smaller than the threshold;

setting, by the processor of the LPC analysis apparatus, the 9th to 72nd value points of the window function as w(n)=1, n=8,9, . . . ,71;

setting, by the processor of the LPC analysis apparatus, the last eight value points of the window function as w(n)=0.16+0.84·cos(2·π·(4·n−285)/127), n=72,73, . . . ,79 when an amplitude value |x[79]| of the last sample point is greater than or equal to the threshold; or setting, by the processor of the LPC analysis apparatus, the last eight value points of the window function as w(n)=0.26+0.74·cos(2·π(4·n−285)/127), n=72,73, . . . ,79 when the amplitude value |x[79]| of the last sample point is smaller than the threshold; and storing the constructed window function in the memory unit of the LPC analysis apparatus.

10. The method according to claim 9, wherein the threshold is 128 or 157.

11. A Linear Prediction Coding (LPC) analysis apparatus for constructing a window function, wherein the window function has 80 value points w(n), n=0,1, . . . ,79, corresponding to 80 sample points of an input signal x[n], n=0,1, . . . ,79, the apparatus comprising: a processor and a memory coupled to the processor;

wherein the processor is configured to:

when an amplitude value |x[0]| of the first sample point of the input signal is greater than or equal to a threshold, set the first eight value points of the window function as $$w(n)=0.16+0.84\cdot\cos(2\cdot\pi\cdot(31-4\cdot n)/127),\ n=0,1,\ldots,7;$$

or when the amplitude value $|x[0]|$ of the first sample point is smaller than the threshold, set the first eight value points of the window function as $$w(n)=0.26+0.74\cdot\cos(2\cdot\pi\cdot(31-4\cdot n)/127),\ n=0,1,\ldots,7;$$

set the 9th to 72nd value points of the window function as $$w(n)=1,\ n=8,9,\ldots,71;$$

when an amplitude value $|x[79]|$ of the last sample point is greater than or equal to the threshold, set the last eight value points of the window function as $$w(n)=0.16+0.84\cdot\cos(2\cdot\pi\cdot(4\cdot n-285)/127),\ n=72,73,\ldots,79;\text{ or}$$

when the amplitude value $|x[79]|$ of the last sample point is smaller than the threshold, set the last eight value points of the window function as $$w(n)=0.26+0.74\cdot\cos(2\cdot\pi(4\cdot n-285)/127),\ n=72,73,\ldots,79;\text{ and}$$

the memory is configured to store the constructed window function.

12. The apparatus according to claim 11, wherein the threshold is 128 or 157.

* * * * *